US006597257B1

(12) United States Patent
Kawanami et al.

(10) Patent No.: US 6,597,257 B1
(45) Date of Patent: Jul. 22, 2003

(54) NONRECIPROCAL CIRCUIT DEVICE AND COMMUNICATION APPARATUS INCORPORATING SAME

(75) Inventors: Takashi Kawanami, Ishikawa-ken (JP); Takashi Hasegawa, Kanazawa (JP)

(73) Assignee: Iurata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/667,173

(22) Filed: Sep. 21, 2000

(30) Foreign Application Priority Data

Sep. 21, 1999 (JP) ..... 11-267011

(51) Int. Cl.[7] ..... H01P 1/36
(52) U.S. Cl. ..... 333/24.2; 333/1.1
(58) Field of Search ..... 333/1.1, 24.2

(56) References Cited

U.S. PATENT DOCUMENTS 5,745,015 A * 4/1998 Tokudera et al. ..... 333/1.1

FOREIGN PATENT DOCUMENTS

| | | | | |
|---|---|---|---|---|
| EP | 0776060 | | 5/1997 | |
| EP | 845 830 | A1 * | 11/1997 | ..... 333/22.4 |
| EP | 903 801 | A2 * | 9/1998 | ..... 333/1.1 |
| JP | 08-023212 | * | 1/1996 | ..... H01P/1/383 |
| JP | 11-097910 | | 4/1999 | ..... H01P/1/383 |

* cited by examiner

*Primary Examiner*—Benny Lee
*Assistant Examiner*—Stephen E. Jones
(74) *Attorney, Agent, or Firm*—Keating & Bennett, LLP

(57) ABSTRACT

The invention discloses a compact and low-priced nonreciprocal circuit device that can reduce insertion losses. In this device, a magnetic assembly is constituted by disposing three central conductors on a planar rectangular magnetic plate. One of the three central conductors is disposed in parallel to the short edges of the magnetic plate.

6 Claims, 4 Drawing Sheets

NONRECIPROCAL CIRCUIT DEVICE AND COMMUNICATION APPARATUS INCORPORATING SAME

BACKGROUND OF THE INVENTION

1. Field of the Invention

The present invention relates to nonreciprocal circuit devices used in high-frequency bands such as a microwave band, for example, isolators, circulators, or the like.

2. Description of the Related Art

In general, a lumped-constant isolator has characteristics in which the amount of attenuation is extremely small in a signal-propagating direction as a forward direction and is extremely large in a reverse direction. This type of isolator is used, for example, in a transmission/reception circuit of a communication apparatus such as a mobile phone. In the recent mobile communication equipment, miniaturization and cost reduction of the equipment are being facilitated. Thus, in addition to that, there is a growing demand for reducing the sizes and costs of nonreciprocal circuit devices incorporated in the mobile communication equipment. In order to achieve the goal, a nonreciprocal circuit device using a quadrangular magnetic plate is provided.

Conventionally, when such a quadrangular magnetic plate is used, in order to keep the characteristic balance between ports, the magnetic plate has a rectangular shape. In addition, one of three central conductors is disposed in parallel to the long edges of the magnetic plate, and the remaining two central conductors are inclined to each edge of the magnetic plate so that the central conductors intersect each other at 120 degrees. For example, Japanese Unexamined Patent Application Publication No. 8-23212 discloses a nonreciprocal circuit device. In this nonreciprocal circuit device, the ratio of the long edge to the short edge of the magnetic plate is set to be $2\sqrt{3}$ and one central conductor is disposed in parallel to the long edge and the lengths of central.conductors are equal.

Meanwhile, in the recent mobile communication equipment such as mobile phones, not only miniaturization but also reduction in power consumption has been strongly needed in order to achieve long-hour communications. Thus, the rectification of insertion losses, that is, the reductions in insertion losses in nonreciprocal circuit devices are being increasingly demanded. In addition, in nonreciprocal circuit devices incorporated in mobile phones, considering insertion losses between specified ports is thought to be important, while insertion losses between the remaining ports are of little concerns. Therefore, further reduction in the insertion losses between the specified ports is more required than maintaining of the characteristic balance between the ports.

However, when the sizes of the magnetic plates are reduced, usually, there is a tendency in which pass bandwidths become narrower and the insertion losses are deteriorated. As a result, in the nonreciprocal circuit devices having the above conventional structure, it is difficult to desirably reduce the insertion losses, although the characteristic balance between the ports can be maintained.

SUMMARY OF THE INVENTION

Accordingly, it is an object of the present invention to provide a compact and low-priced nonreciprocal circuit device capable of reducing an insertion loss, and a communication apparatus incorporating the same.

In order to accomplish the above object, according to an aspect of the present invention, there is provided a nonreciprocal circuit device including a magnetic member to which a DC magnetic field is applied, and three central conductors disposed on the magnetic member to intersect each other in an electrically insulated state. In this nonreciprocal circuit device, the magnetic member has a planar rectangular configuration having long and short edges, and one of the three central conductors is disposed in parallel to the short edges of the magnetic member.

With this arrangement, as described below, the insertion loss between the ports of the two central conductors apart from the central conductor disposed in parallel to the short edges of the magnetic member can be reduced. The reason for this is that the lengths of the two remaining central conductors become longer than the length of the central conductor disposed in parallel to the short edges of the magnetic member, thereby leading to the strengthening of a coupling between the two central conductors.

In addition, in this nonreciprocal circuit device, a terminating resistor may be connected to a port of the central conductor disposed in parallel to the short edges of the magnetic member so as to form an isolator.

In addition, the two central conductors apart from the central conductor disposed in parallel to the short edges of the magnetic member may intersect each other at an angle $\theta$, which is greater than 120 degrees and less than 180 degrees. This arrangement permits the insertion loss to be reduced. This is because that the coupling between the two central conductors is strengthened by setting the intersecting angle $\theta$ to be greater than 120 degrees.

In addition, in the nonreciprocal circuit device, each of the central conductors may be extended from a common grounding section to be bent on the magnetic member disposed on the grounding section, and the two central conductors apart from the central conductor disposed in parallel to the short edges of the magnetic member may intersect each other at an angle, which is greater than 120 degrees and less than or equal to 140 degrees. This is because, when the intersecting angle $\theta$ is set to be greater than 140 degrees, the two central conductors apart from the central conductor parallel to the short edges of the magnetic member are mutually overlapped at the end portions of the magnetic member. As a result, the two conductors cannot be disposed by bending on the magnetic member.

According to another aspect of the present invention, there is provided a communication apparatus including the above nonreciprocal circuit device as an isolator. With this arrangement, power consumption of the communication apparatus can be reduced.

DESCRIPTION OF THE PREFERRED EMBODIMENTS

Referring to FIGS. 1 to 4, a description will be given of the structure of a nonreciprocal circuit device according to a first embodiment of the present invention.

Figure 1:
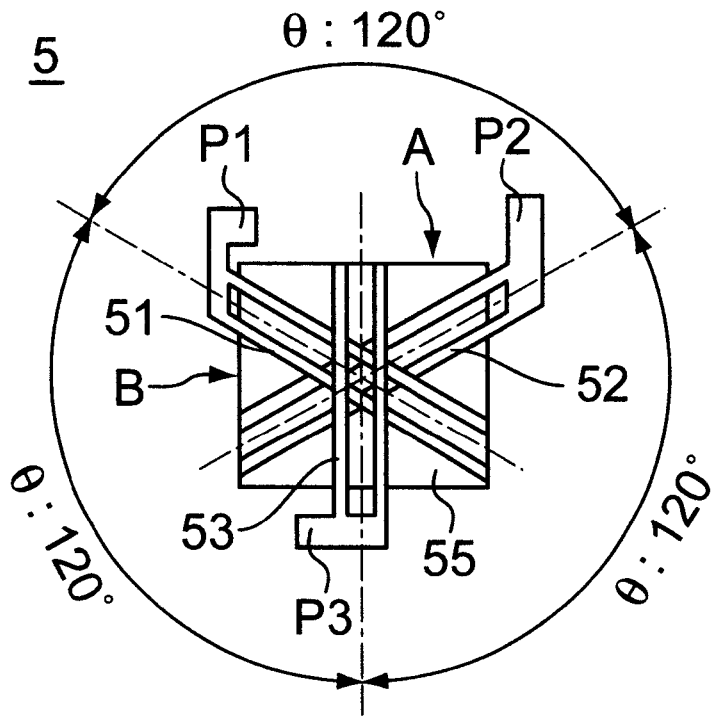
FIG. 1 is a plan view of a magnetic assembly incorporated in an isolator according to a first embodiment of the present invention.
Figure 2:
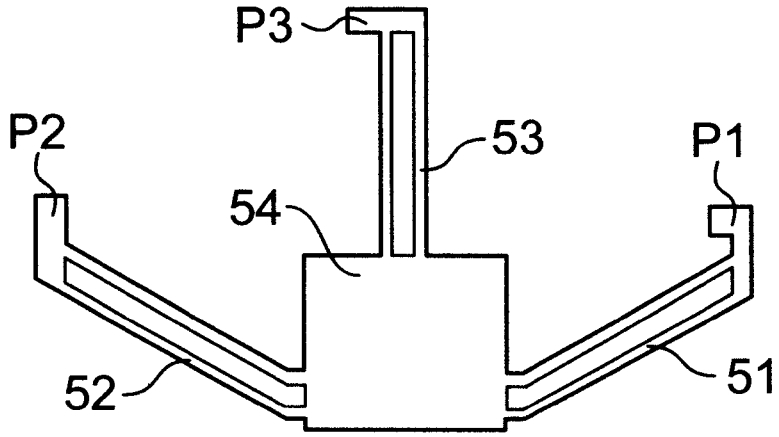
FIG. 2 is a developed view of central conductors incorporated in the isolator according to the first embodiment.

The nonreciprocal circuit device of the first embodiment has a magnetic assembly 5, in which three central conductors 51, 52, and 53 are disposed on a planar rectangular magnetic plate 55 as shown in FIG. 1. The central conductors 51, 52, and 53 are formed by stamping a conductive plate made of a metal such as copper. In a developed view of the central conductors shown in FIG. 2, the central conductors 51, 52, and 53 are integrally formed by a grounding section 54 as a common grounding end to be extended outwardly from the grounding section 54.

In the magnetic assembly 5, the magnetic member 55 is mounted on the common grounding section 54, and the central conductors 51 to 53 are bent to be disposed on the upper surface of the magnetic member 55 in such a manner that the central conductors 51, 52, and 53 intersect each other at angles θ of 120 degrees via an insulating sheet (not shown). Ports P1 to P3 corresponding to the top end portions of the respective central conductors 51 to 53 have configurations suitable to connections with other members, and the ports P1 to P3 are extended outwardly from the periphery of the magnetic member 55. In this arrangement, the lengths of the portions of the central conductors 51 to 53 located on the upper surface of the magnetic member 55 effectively serve to determine the characteristics of the nonreciprocal circuit device.

In the nonreciprocal circuit device of the first embodiment, the central conductor 53 is disposed in parallel to short edges B of the magnetic member 55 at the central part of long edges A thereof, that is, at a central part between both short edges. In other words, the effective length of the central conductor 53 disposed in parallel to the short edges B is set to be shorter than the effective lengths of the remaining central conductors 51 and 52. In this embodiment, the ratio of the long edge A to the short edge B of the magnetic member 55 is set to be 10:9.

Figure 3:
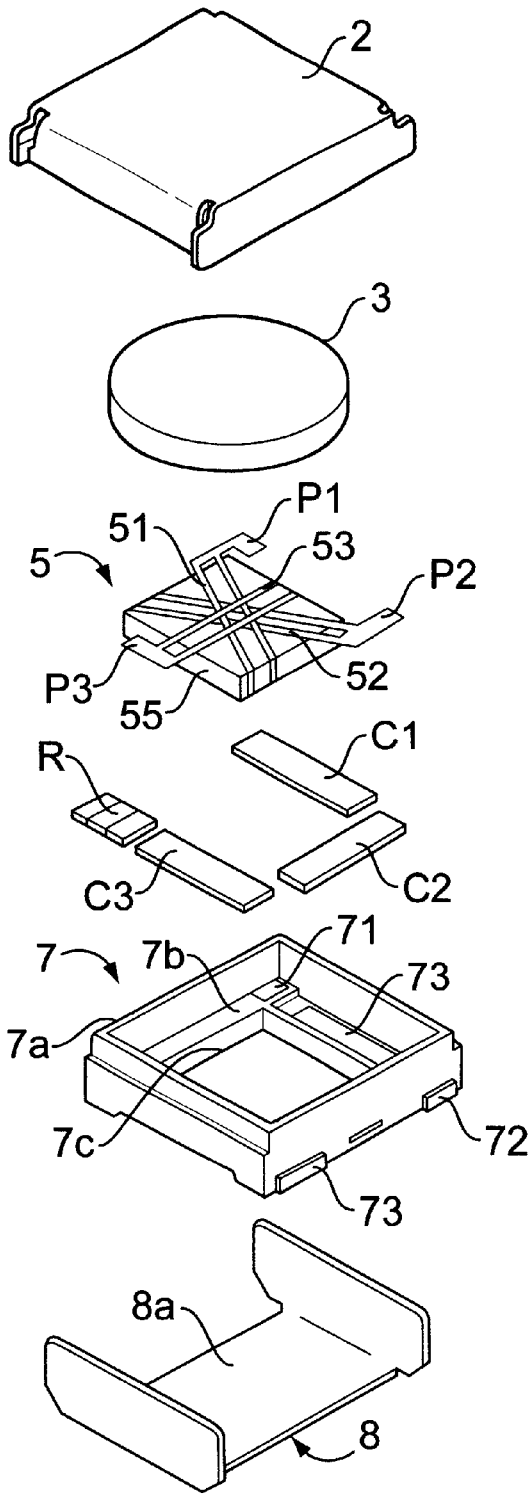
FIG. 3 is an exploded perspective view showing the overall structure of the isolator according to the first embodiment.
Figure 4:
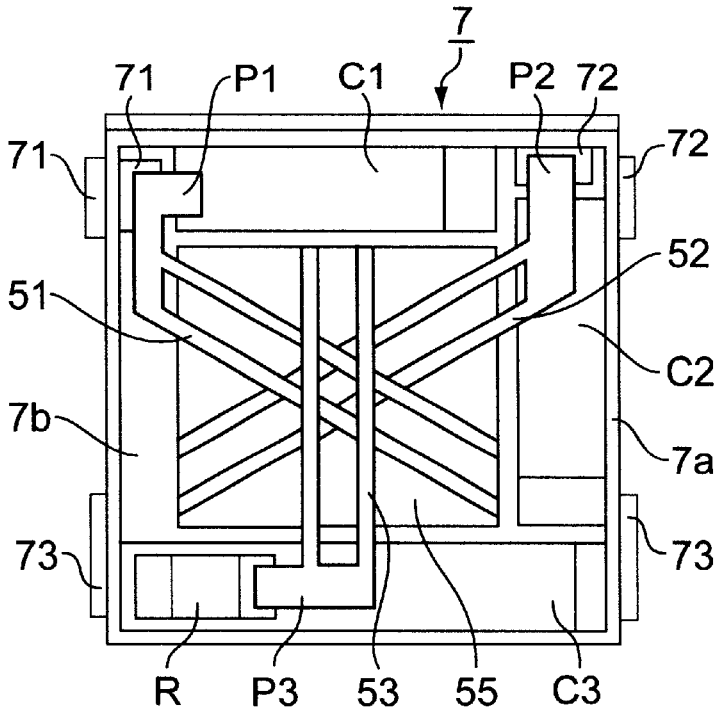
FIG. 4 is plan view of the isolator according to the first embodiment in a state in which a permanent magnet and an upper yoke are removed.

Each of FIGS. 3 and 4 shows an example of a nonreciprocal circuit device constituted by using the above magnetic assembly 5. FIG. 3 is an exploded perspective view showing the overall structure of the nonreciprocal circuit device. FIG. 4 is a plan view of the nonreciprocal circuit device in a state in which a permanent magnet and an upper yoke are removed. In this nonreciprocal circuit device, a terminating resistor R is connected to the port P3 of the central conductor 53 parallel to the short edges B of the magnetic member 55 to form an isolator. In addition, the direction from the port P1 to the port P2 is a forward direction, while the direction from the port P2 to the port P1 is a reverse direction.

In the arrangement of the isolator, a permanent magnet 3 is disposed on the inner surface of a box-shaped upper yoke 2 formed of a magnetic metal, and a substantially C-letter-formed lower yoke 8 similarly formed of a magnetic metal is attached to the upper yoke 2 to form a magnetic closed circuit. In addition, a terminal case 7 is disposed on a bottom 8*a* inside the lower yoke 8, and the magnetic assembly 5, matching capacitors C1 to C3, and a terminating resistor R are disposed inside the terminal case 7. A DC magnetic field is applied to the magnetic assembly 5 by the magnetic permanent 3.

The terminal case 7, which is formed of an electrically insulating material, has a structure in which a bottom wall 7*b* is integrally formed with a side wall 7*a* having a rectangular-frame configuration. Parts of input/output terminals 71 and 72 and grounding terminals 73 are embedded in resin materials. An insertion hole 7*c* is formed substantially at the center of the bottom wall 7*b*. At the peripheral parts of the insertion hole 7*c* is formed a plurality of recesses in specified positions.

In the recesses formed on the periphery of the insertion hole 7*c*, the matching capacitors C1 to C3 and the terminating resistor R are fitted. The magnetic assembly 5 is interposed inside the insertion hole 7*c*. The permanent magnet 3 is disposed on the top of the magnetic assembly 5.

The common grounding section 54 on the lower surface of the magnetic assembly 5 is connected to a bottom surface 8a of the lower yoke 8. Lower-surface electrodes of the matching capacitors C1 to C3 and an one-end electrode of the terminating resistor R are connected to the grounding terminals 73, respectively. Upper-surface electrodes of the matching capacitors C1 to C3 are connected to the ports P1 to P3 of the central conductors 51 to 53. The other end of the terminating resistor R is connected to the port P3.

In this isolator, since the rectangular magnetic member is used, the material cost and production cost of the magnetic member are reduced to obtain a low cost production. Additionally, the miniaturization of the magnetic assembly is achieved. Moreover, in terms of the arrangement of the members disposed in the terminal case, efficiency in using the area around the magnetic member can be increased to achieve the overall miniaturization of the isolator.

Figure 5:
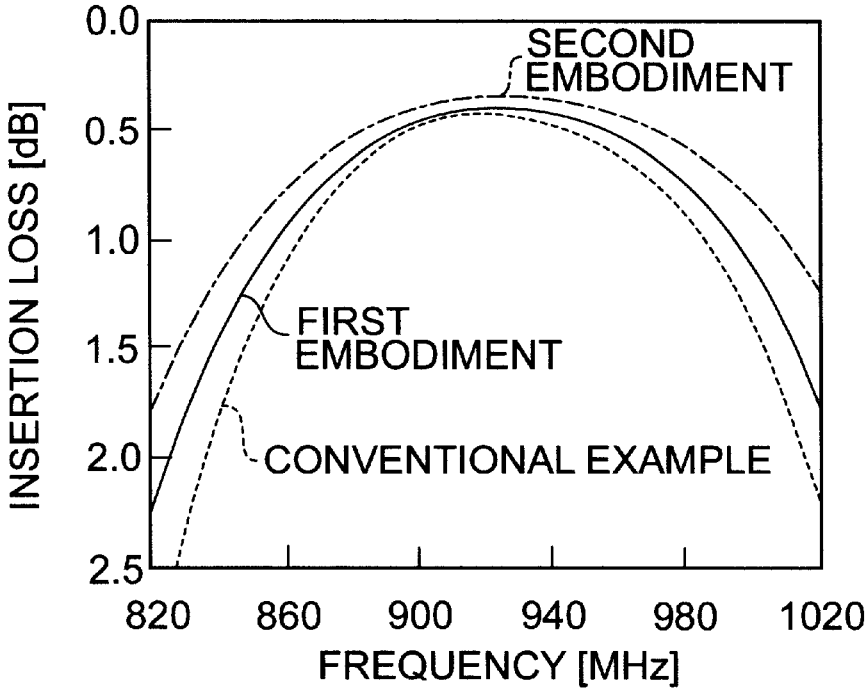
FIG. 5 is graph showing the frequency characteristics of insertion losses of the isolator according to the first embodiment, an isolator according to a second embodiment of the present invention, and a conventional isolator.

Next, referring to FIG. 5, a description will be given of the structural advantages of the isolator according to the first embodiment. FIG. 5 is a graph showing the frequency characteristics of insertion losses (the amount of attenuation in a forward direction) in the isolator of the first embodiment and a conventional isolator. The magnetic member used in the first embodiment has long edges of 3.0 mm, short edges of 2.7 mm, and a thickness of 0.5 mm. A magnetic member used in the conventional isolator has long edges of 3.1 mm, short edges of 2.7 mm, with a thickness of 0.5 mm, in which the ratio of the long edge to the short edge is set to be $2:\sqrt{3}$. In this conventional magnetic assembly, a central conductor connected to a terminating resistor R is disposed in parallel to the long edges of the magnetic member. Each of the above isolators has the outline dimensions of 5×5 mm with a height (thickness) of 2.0 mm. The central frequency of each isolator is 924.5 MHz.

As shown in FIG. 5, regarding the insertion losses at the central frequency, the insertion loss in the first embodiment is approximately 0.40 dB, which is greatly lower than the insertion loss (approximately 0.45 dB) in the conventional isolator. In addition, the pass bandwidth of the first embodiment, for example, a bandwidth at the insertion loss of 0.75 dB, is greatly wider than that of the conventional example. As shown here, with the use of the planar rectangular magnetic member 55, since the central conductor 53 connected to the terminating resistor R is disposed in parallel to the short edges of the magnetic member 55, the insertion loss between the signal input/output ports P1 and P2 can be reduced. That is, in the isolator of the first embodiment, both miniaturization and reduction of insertion losses can be achieved.

Figure 6:
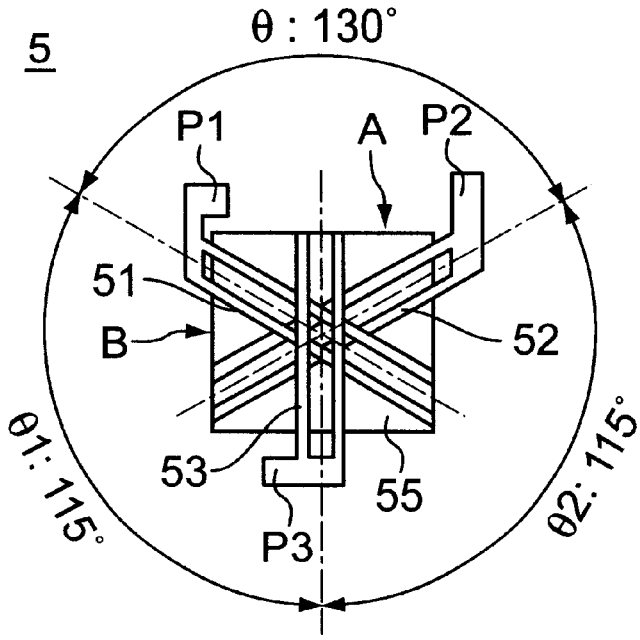
FIG. 6 is a plan view of a magnetic assembly of the isolator according to the second embodiment.

Next, FIG. 6 shows the structure of a magnetic assembly used in an isolator according to a second embodiment of the present invention. The magnetic assembly 5 of the second embodiment uses a planar rectangular magnetic plate 55. A central conductor 53 is disposed in parallel to the short edges of the magnetic plate 55, and the remaining two central conductors 51 and 52 are disposed such that an angle θ at which the two central conductors 51 and 52 cross each other is set to be 130 degrees. In addition, the central conductor 53 is arranged so as to bisect the angle θ at which the central conductors 51 and 52 cross each other. In this case, both an angle θ1 at which the central conductors 53 and 51 cross each other and an angle θ2 at which the central conductors 53 and 52 cross each other are set to be 115 degrees, respectively. The other structures are the same as those used in the first embodiment shown in FIG. 1, and explanation thereof is omitted.

Next, referring to FIG. 5, a description will be given of the advantages of the structure of the isolator in accordance with the second embodiment. The characteristics of the isolator according to the second embodiment shown in FIG. 5 are the same as those of the isolator according to the first embodiment shown in FIGS. 3 and 4.

As shown in FIG. 5, in the second embodiment, the insertion loss at a central frequency is approximately 0.35 dB. This is lower than the value shown in the first embodiment. Moreover, the pass bandwidth in the second embodiment is greatly wider than that in the first embodiment. As shown here, except for the central conductor 53 disposed in parallel to the short edges of the magnetic member 55, when the angle θ at which the two central conductors 51 and 52 corresponding to the remaining signal input/output ports cross each other is set to be 130 degrees, the insertion loss between the signal input/output ports P1 and P2 can be more reduced.

In the second embodiment, the case in which the crossing angle θ of the central conductors 51 and 52 is set to be 130 degrees has been described as an example. It has been found that the insertion loss can be reduced by setting the crossing angle θ to be greater than 120 degrees. In contrast, as shown in the above embodiments, when the central conductors formed by metal conductive plates are bent on the magnetic member, if the crossing angle θ is set to be greater than 140 degrees, the two central conductors apart from the central conductor parallel to the short edges of the magnetic member are overlapped at the end portions of the magnetic member so that the two central conductors cannot be bent to be disposed. As a result, substantially, the crossing angle θ of the central conductors 51 and 52 is set to be less than or equal to 140 degrees.

In the above embodiment, there has been provided the example in which the central conductors formed by the metal conductive plates are bent on the magnetic member. However, the structures of the magnetic member and the central conductors applicable to the present invention are not limited to this structure. For example, the invention can use a structure in which central conductors formed of electrode films are formed inside a magnetic member or on a surface thereof. In this case, the crossing angle θ of the two central conductors apart from the central conductor parallel to the short edges of the magnetic member can be theoretically set to be any degree in a range of less than 180 degrees. However, when the crossing angle θ is greater than 150 degrees, required isolation (the amount of attenuation in a reverse direction) cannot be obtained. Therefore, the crossing angle θ is set to be less than or equal to 150 degrees.

Furthermore, in the above embodiments, the examples of the isolators have been described. However, the present invention can be applied to a circulator, for example, in which a port P3 is formed as a third input/output port without connecting a terminating resistor R to the port P3. In this case, the insertion loss between the ports of the two central conductors apart from the central conductor disposed parallel to the short edges of the magnetic member can also be reduced.

Figure 7:
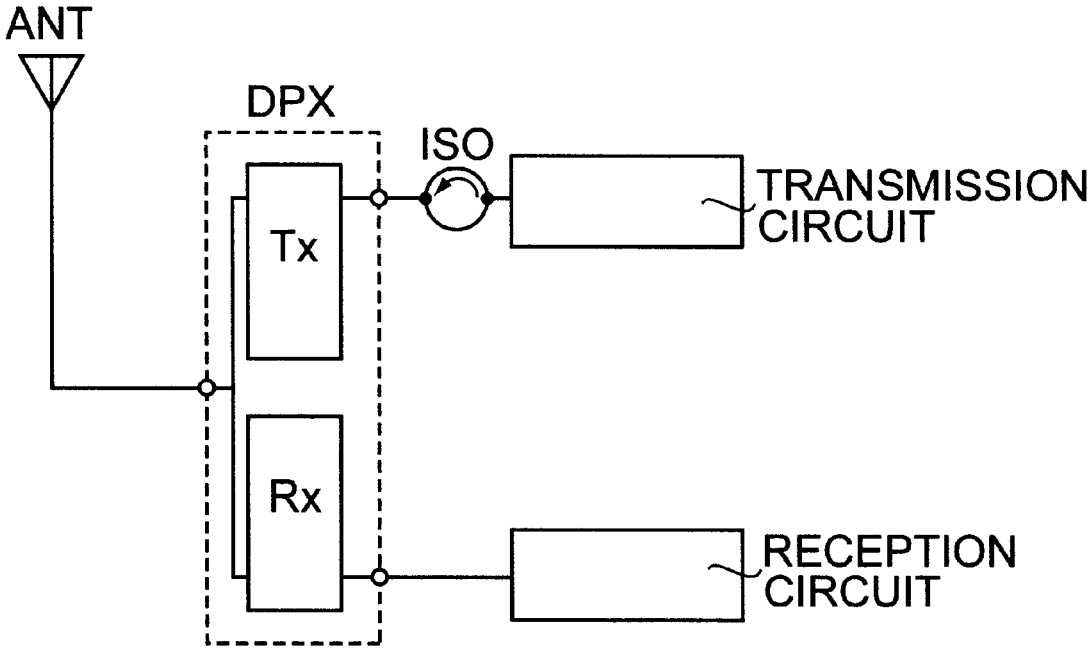
FIG. 7 is a block diagram of a communication apparatus according to a third embodiment of the present invention.

Next, FIG. 7 shows the structure of a communication apparatus according to a third embodiment of the present invention. In this communication apparatus, an antenna ANT is connected to the antenna end of a duplexer DPX constituted by a transmission filter TX and a reception filter RX, an isolator ISO is connected between an input end of the transmission filter TX and a transmission circuit, and a reception circuit is connected to an output end of a reception filter RX. A signal transmitted from the transmission circuit is entered through the isolator ISO to the transmission filter TX, and is output from.the antenna ANT. The signal received in the antenna ANT is sent through the reception filter RX to the reception circuit.

In this situation, as the isolator ISO, the isolator in accordance with one of the first and second embodiments can be used. With the use of the isolator of the present invention, which can reduce insertion losses, power consumption in the communication apparatus can be reduced.

As described above, in the nonreciprocal circuit device according to the present invention, the magnetic member has a planar rectangular configuration having short and long edges. In addition, one of the three central conductors is disposed in parallel to the short edges of the magnetic member. With this arrangement, except for the central conductor parallel to the short edges of the magnetic member, the insertion loss between the ports of the remaining two central conductors can be reduced.

In addition, the crossing angle θ of the remaining two central conductors is set to be greater than 120 degrees. This arrangement permits the insertion loss to be more reduced.

Furthermore, the communication apparatus according to the present invention can reduce power consumption by incorporating the nonreciprocal circuit device described above.

The foregoing invention has been described in terms of preferred embodiments. However, those skilled in the art will recognize that many variations of such embodiments exist. Such variations are intended to be within the scope of the present invention and the appended claims.

What is claimed is:

1. A nonreciprocal circuit device comprising:

a magnetic member to which a DC magnetic field is applied; and three central conductors disposed on the magnetic member to intersect each other in an electrically insulated state;

wherein the magnetic member has a planar rectangular configuration having long and short edges, and one of the three central conductors is disposed in parallel to the short edges of the magnetic member, further comprising:

the central conductor disposed in parallel to the short edges of the magnetic member having a port;

a terminating resistor connected to the port;

wherein the central conductor connected to the terminating resistor has a shorter effective length than the other two central conductors and crosses the long edges of the magnetic member; and wherein the two central conductors not disposed in parallel to the short edges of the magnetic member cross the short edges of the magnetic member.

2. A nonreciprocal circuit device according to claim 1, Wherein the two central conductors apart from the central conductor disposed in parallel to the short edges of the magnetic member intersect each other at an angle θ which Is greater than 120 degrees and less than 180 degrees.

3. A nonreciprocal circuit device according to claim 2, wherein said angle θ is less than 150 degrees.

4. A nonreciprocal circuit device according to claim 1, wherein each of the central conductors is extended from a common grounding section to be bent on the magnetic member disposed on the grounding section, and the two central conductors apart from the central conductor disposed in parallel to the short edges of the magnetic member intersect each other at an angle θ which is greater than 120 degrees and less than or equal to 140 degrees.

5. A communication apparatus comprising the nonreciprocal circuit device according to claim 1.

6. A nonreciprocal circuit device according to claim 1, wherein said long and short edges of said magnetic member have respective lengths with a length ratio of 10:9.

* * * * *